United States Patent [19]

Matias

[11] Patent Number: 4,577,860

[45] Date of Patent: Mar. 25, 1986

[54] ADJUSTABLE EXERCYCLE FOR PROVIDING SIMULATED RUNNING EXERCISES

[76] Inventor: René Matias, 2414 Fidelidad St., Hacienda Heights, Calif 91745; Leroy R. Perry, Jr., 3283 Motor Ave., Los Angeles, Calif. 90034

[21] Appl. No.: 628,644

[22] Filed: Jul. 6, 1984

[51] Int. Cl.[4] ..... A63B 21/00; A63B 69/16

[52] U.S. Cl. ..... 272/73; 272/DIG. 4

[58] Field of Search ..... 272/73, DIG. 4; D12/111; D21/194

[56] References Cited

U.S. PATENT DOCUMENTS

| | | | |
|---|---|---|---|
| 3,731,921 | 5/1973 | Andrews, Jr. | 272/DIG. 4 X |
| 3,848,870 | 11/1974 | Craig | 272/DIG. 4 X |
| 4,007,927 | 2/1977 | Proctor | 272/73 |
| 4,061,460 | 12/1977 | George | 272/73 X |

*Primary Examiner*—Richard J. Apley
*Assistant Examiner*—Kathleen D'Arrigo
*Attorney, Agent, or Firm*—W. Edward Johansen

[57] ABSTRACT

The present invention is an adjustable exercising apparatus for simulating the running. The exercising apparatus include a frame including first and second inverted U-shaped mounting members which are parallelly disposed to each other and each of which has front and rear legs. The frame also includes first base and second members fixedly coupled to the front and rear legs, respectively, of the first and second mounting members. The exercising apparatus also includes an inverted V-shaped supporting member which has front and rear legs fixedly coupled to the first and second base members, respectively, a driving mechanism for providing a user with resistance to driving in response to his movement of the set of pedals mechanically coupled to the supporting member and to the first and second mounting members, and a pedal mounting mechanism for mounting a set of pedals. A seat mounting mechanism includes a seat support pole which is adjustably coupled to the seat, a first pivotal mounting bracket for pivotally coupling the seat support pole to the supporting member and a first locking mechanism for locking the seat support pole in place at multiple angles to the first and second mounting members. A handlebar mounting mechanism include a handlebar support pole which is adjustably coupled to the set of handlebars, a second pivotal mounting bracket for pivotally coupling the handlebar support pole to the supporting member and a second locking mechanism for locking the handlebar support pole in place at multiple angles to the first and second mounting U-shaped members.

6 Claims, 2 Drawing Figures

ADJUSTABLE EXERCYCLE FOR PROVIDING SIMULATED RUNNING EXERCISES

BACKGROUND OF THE INVENTION

1. Field of the Invention

The present invention relates to an adjustable exercising apparatus which allows a user to practice running while he is exercising and more particularly to an exercising apparatus which a user can adjust not only to his physical dimensions, but also to allow him to perform a plurality of exercises.

2. Description of the Prior Art

Exercycles have been one of the most popular pieces of exercise equipment found in gymnasiums and health spas for many years. In recent years, such equipment has enjoyed increasing popularity in the area of physical therapy. It is extremely important that a wide variety of seat and handlebar positions to accommodate a variety of riding positions, be it of necessity for a handicapped person or mere preference for a healthy person. In any event, the prior art suffered from the problem of that such adjustments could not be readily made without the necessity of tools. It is highly desirable to be able to make these adjustments not only without the necessity of tools, but also relatively simply and quickly. Numerous handlebar structures have been used in the past. U.S. Pat. No. 2,180,617 and U.S. Pat. No. 2,505,648 teach height adjustment features for the handlebars.

U.S. Pat. No. 4,007,927, entitled Inertial Cycle Exerciser, issued to Richard I. Proctor on Feb. 15, 1977, teaches an inertial cycle exerciser which includes a stationary frame on a supporting surface and a flywheel. The stationary frame carries a handlebar and a seat so that it can accomodate a person wishing to exercise. The flywheel is disposed above the supporting surface and is journaled on the stationary frame for rotation by a pair of pedals. The inertial cycle exerciser also includes an adjustment knob and a pair of brake shoes. The adjustment knob is disposed on the stationary frame and enables a rider to control the amount of braking resistance which is exerted on the flywheel by the pair of brake shoes.

U.S. Pat. No. 4,305,578, entitled Exerciser Equipment, issued to Richard A. Disbrow and Russel O. Blanchard on Dec. 15, 1981, teaches an exercycle which has a continuous U-shaped frame with two upwardly extending posts bridged by a substantially linear connecting portion positioned closely to and paralleling the floor. A seat is attached to the end of one of the posts and handlebars are secured to the end of the other post. Pedals are affixed to the seat post between the seat and the connecting portion of the frame. A wheel is disposed rearwardly of the seat post. A drive mechanism, coupled between the pedals and the wheel serves to impart rotational movement to the wheel when the pedals are moved by the user. The construction of the exercycle provides an unobstructed passageway between the handlebars and the seat to facilitate easy mounting and dismounting of the apparatus by user. The handlebars and seat are provided with unique adjustment assemblies that can be used without needing tools.

U.S. Pat. No. 4,313,602, entitled Cycle-type Exerciser, issued to James P. Sullivan on Feb. 2, 1982, teaches an exercise device which simulates the riding of a bicycle and which includes a supporting frame, handlebars, a seat, a front wheel and pedal cranks engageable by the wheel. The degree of rotational movement to the front wheel can readily be adjusted by the trainee during performance of the exercise. The exercise device also includes a unique impedance indicating feature which dynamically indicates to the trainee the degree of resistance against rotation of the front wheel which is being experienced at any given time.

U.S. Pat. No. 4,364,557, entitled Work Control Apparatus in an Exerciser, issued to Ronald A. Serati on Dec. 21, 1982, teaches a work control apparatus in a bicycle exerciser which has a driven member that is rotatively mounted on an exerciser frame. The work control apparatus includes a rotatively mounted knob that is connected to a brake for the driven member in order to selectively determine the braking pressure exerted on the driven member. The brake includes a lever pivotally attached to the exerciser frame and having a brake roller at one end engaging the exerciser driven member and the knob is adjustably connected to the other end of the brake lever and is rotatable to exert a predetermined braking pressure between the roller and the driven member. The knob is drivingly connected to a rotatively mounted indicator wheel for rotating the wheel an angular distance less than the corresponding angular distance of the knob upon rotation of the knob incident to adjusting the braking pressure. The drive includes an idler wheel connected to the knob and the indicator wheel by endless flexible elements and a cover which has a window is mounted above the indicator wheel to selectively reveal numerical indicia on the indicator wheel as the knob is rotated.

U.S. Pat. No. 4,421,308, entitled Bicycle Exercise Stand, issued to Gerald A. Nagy on Dec. 20, 1983, teaches a bicycle exercise stand which supports the rear of a bicycle in such a manner that the user can perform stationary bicycle exercises. The bicycle exercise stand includes a pair of upright tubular members and a pair of right angle pins which support the bicycle wheel axle such that its vertical and horizontal position on the bicycle exercise can be adjusted to accommodate wheels of different diameters and widths. The pins are carried by the bicycle rear axle during normal street use.

U.S. Pat. No. 4,353,544, entitled Pole Supported Bicycle-Type Exerciser, issued to W. Don Wiley on Oct. 12, 1982, teaches a frame which is equipped with a seat that is vertically slidably supported on an upright pole which has handle bars at its upper end. The frame is provided with pedals and a crank which angularly rotates a reel about a horizontal axis in order to wind an elongated flexible member thereon. The elongated flexible member is secured at one end to an intermediate portion of the pole in order to lift the frame and an occupant in response to angular rotation of the reel in one direction. Downward movement of the frame from its lifted position is retarded by air trapped below a piston which is moved upwardly with the frame in a tube to from a brake.

SUMMARY OF THE INVENTION

In view of the foregoing factors and conditions which are characteristic of the prior art it is the primary object of the present invention to provide an adjustable exercising apparatus for running which a user can adjust to adjustable angles.

It is another object of the present invention to provide an adjustable exercising apparatus for running riding which allow a user to perform a plurality of exercises.

In accordance with the present invention an embodiment of an adjustable exercising apparatus for running is described. The adjustable exercising apparatus includes a frame including first and second inverted U-shaped mounting members which are parallelly disposed to each other and each of which has front and rear legs. The frame also includes first base and second members fixedly coupled to the front and rear legs, respectively, of the first and second mounting members. The exercising apparatus also includes an inverted V-shaped supporting member which has front and rear legs fixedly coupled to the first and second base members, respectively, a driving mechanism for providing a user with resistence to driving in response to his movement of the set of pedals mechanically coupled to the supporting member and to the first and second mounting members, and a pedal mounting mechanism for mounting a set of pedals. A seat mounting mechanism includes a seat support pole which is adjustably coupled to the seat, a first pivotal mounting bracket for pivotally coupling the seat support pole to the supporting member and a first locking mechanism for locking the seat support pole in place at multiple angles to the first and second mounting members. A handlebar mounting mechanism include a handlebar support pole which is adjustably coupled to the set of handlebars, a second pivotal mounting bracket for pivotally coupling the handlebar support pole to the supporting member and a second locking mechanism for locking the handlebar support pole in place at multiple angles to the first and second mounting U-shaped members.

The features of the present invention which are believed to be novel are set forth with particularity in the appended claims.

Other claims and many of the attendant advantages will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
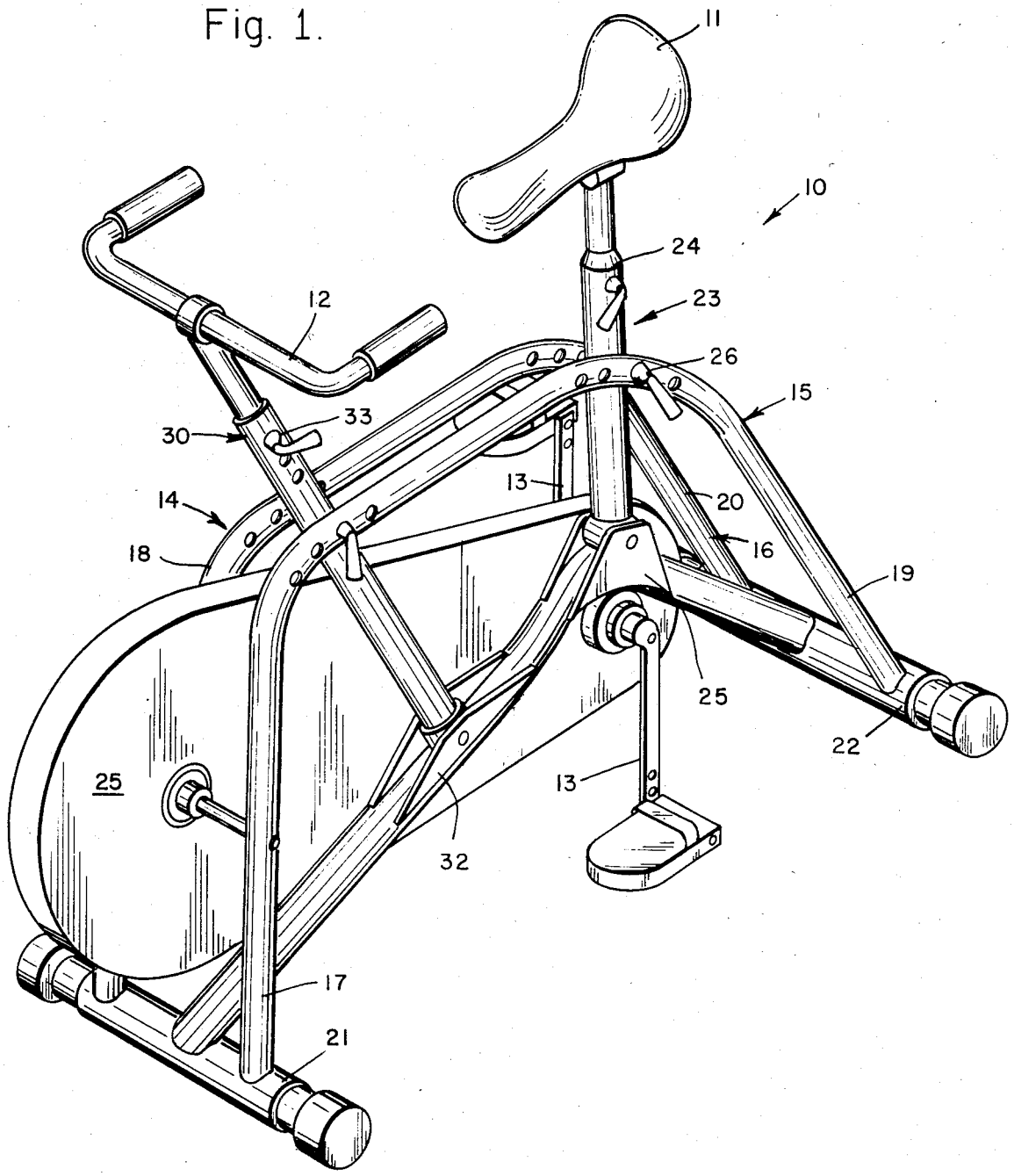
FIG. 1 is a perspective drawing of an adjustable exercising apparatus for running which has been constructed in accordance with the principles of the present invention.

In order to best understand the present invention it is necessary to refer to the following description of its preferred embodiment in conjunction with the figure of accompanying drawing. Referring to FIG. 1 in conjunction with FIG. 2 an adjustable exercising apparatus 10 for running which includes a seat 11, a set of handlebars 12 and a set of pedals 13. The adjustable exercising apparatus also includes a frame 14 having a first inverted U-shaped member 15 and a second inverted U-shaped member 16, which is parallelly disposed to the first inverted U-shaped member 15. Each of the first and second inverted U-shaped members 15 and 16 has a front leg 17 and 18, respectively, and a rear leg 19 and 20, respectively. A first base member 21 is fixedly coupled to the front legs 17 and 18 of the first and second inverted U-shaped members 15 and 16 and a second base member 22 is fixedly coupled to the rear leg 19 and 20 of the first and second inverted U-shaped members 15 and 16. The adjustable exercising apparatus 10 further includes an inverted V-shaped supporting member which has a front leg which is fixedly coupled to the first base member 21 and a rear leg which is fixedly coupled to the second base member 22 and a driving mechanism which provides a user with resistence to driving in response to his movement of the set of pedals 13 and which is mechanically coupled to the inverted V-shaped supporting member and to the first and second first and second inverted U-shaped members 15 and 16.

Referring to FIG. 1 a pedal mounting mechanism on which the set of pedals 13 is mounted and which is mechanically coupled to the inverted V-shaped supporting member. U.S. Pat. No. 4,007,927 and U.S. Pat. No. 4,079,931 teach exercycles with similar pedal mounting mechanisms. The placement of the set of pedals 13 is adjustable to both the user's physical dimension and to multiple foot positions.

Figure 2:
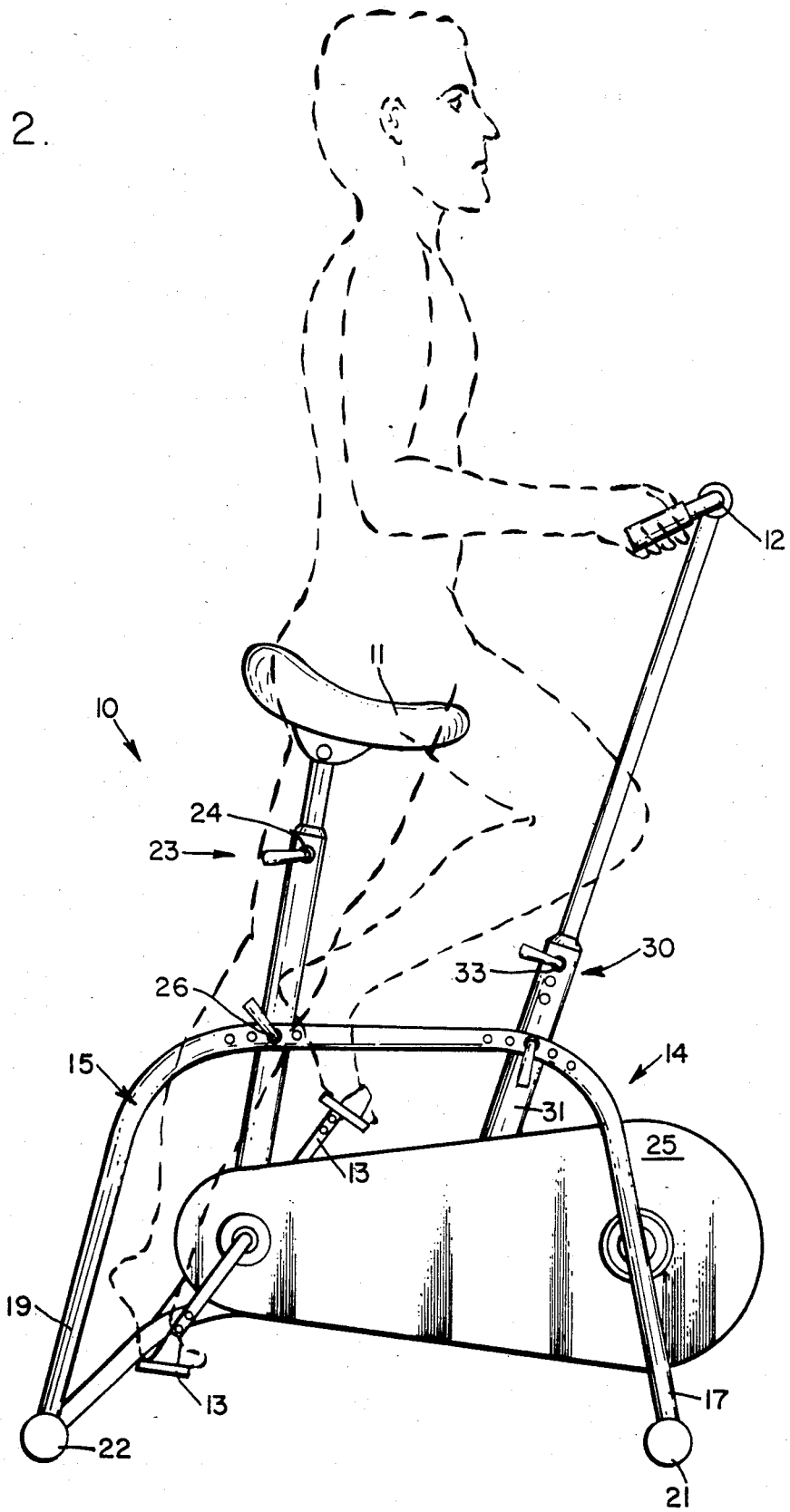
FIG. 2 is a side elevational view of the adjustable exercising apparatus for running of FIG. 1 showing a person who is running on the adjustable exercising apparatus.

Referring again to FIG. 1 in conjunction with FIG. 2 a seat mounting mechanism 23 includes a seat support pole 24 which is adjustably coupled to the seat 11, first pivotal mount 25 which pivotally couples the seat support pole 24 to the inverted V-shaped supporting member and a first locking mechanism 26 which locks the seat support pole 24 in place at multiple angles to the first and second inverted U-shaped members 15 and 16. U.S. Pat. No. 4,417,724 teaches an adjustable seat mounting mechanism which is not pivotally coupled to the frame. A handlebar mounting mechanism 30 includes a handlebar support pole 31 which is adjustably coupled to the set of handlebars 13, second pivotal mount 32 which pivotally couples the handlebar support pole 31 to the inverted V-shaped supporting member and a second locking mechanism which locks the handlebar support pole 31 in place at multiple angles to the first and second first and second inverted U-shaped members 15 and 16.

From the foregoing it can be seen that an adjustable exercising apparatus for riding has been described. It should be noted that the sketch is not drawn to scale and that distances of the figure are not to be considered significant.

Accordingly it is intended that the foregoing disclosure and showing made in the drawing shall be considered only as an illustration of the principles of the present invention.

What is claimed is:

1. An exercising apparatus for simulating the riding of a exercycle which includes a seat, a set of handlebars and a pair of pedals, said exercising apparatus comprising:

a. a frame including a first inverted U-shaped member and a second inverted U-shaped member which is parallelly disposed to said first inverted U-shaped member, each of said first and second inverted U-shaped members having a front leg and a rear leg, and a first base member which is fixedly coupled to said front leg of said first and second inverted U-shaped members and a second base member which is fixedly coupled to said rear leg of said first and second inverted U-shaped members;

b. an inverted V-shaped supporting member having a front leg which is fixedly coupled to said first base member and a rear leg which is fixedly coupled to said second base member;

c. driving means for providing a user with resistence to driving in response to his movement of the pair of pedals, said driving means being mechanically coupled to said inverted V-shaped supporting member and to said first and second inverted U-shaped members;

d. handlebar mounting means for mounting the set of handlebars, said handlebar mounting means being mechanically coupled to said inverted V-shaped supporting member and to said first and second inverted U-shaped members;

e. pedal mounting means for mounting the pair of pedals, said pedal mounting means being mechanically coupled to said inverted V-shaped supporting member;

f. a seat support pole which is adjustably coupled to the seat;

g. first pivotal mounting means for pivotally coupling said seat support pole at multiple angles to said inverted V-shaped supporting member; and h. first locking means for adjustably locking said seat support pole in place to said first and second inverted U-shaped members.

2. An exercising apparatus for simulating the riding of a exercycle according to claim 1 wherein said handlebar mounting means comprises:

a. a handlebar support pole which is adjustably coupled to the set of handlebars;

b. second pivotal mounting means for pivotally coupling said handlebar support pole to said inverted V-shaped supporting member; and c. second locking means for adjustably locking said handlebar support pole in place to said first and second inverted U-shaped members.

3. An exercising apparatus for simulating the riding of a exercycle according to claim 1 wherein said pedal mounting means comprises a pair of shafts on each of which one of the pair of pedals is adjustably mounted so that a user may adjust the pair of pedals to multiple foot positions.

4. An exercising apparatus for simulating the riding of a exercycle according to claim 2 wherein said pedal mounting means comprises a pair of shafts on each of which one of the pair of pedals is adjustably mounted so that a user may adjust the pair of pedals to multiple foot positions.

5. An exercising apparatus for simulating the riding of a exercycle which includes a seat, a set of handlebars and a pair of pedals, said exercising apparatus comprising:

a. a frame including a first inverted U-shaped member and a second inverted U-shaped member which is parallelly disposed to said first inverted U-shaped member, each of said first and second inverted U-shaped members having a front leg and a rear leg, and a first base member which is fixedly coupled to said front leg of said first and second inverted U-shaped members and a second base member which is fixedly coupled to said rear leg of said first and second inverted U-shaped members;

b. an inverted V-shaped supporting member having a front leg which is fixedly coupled to said first base member and a rear leg which is fixedly coupled to said second base member;

c. driving means for providing a user with resistence to driving in response to his movement of the pair of pedals, said driving means being mechanically coupled to said inverted V-shaped supporting member and to said first and second inverted U-shaped members;

d. seat mounting means for mounting the seat, said seat mounting means being mechanically coupled to said inverted V-shaped supporting member and to said first and second inverted U-shaped members;

e. pedal mounting means for mounting the pair of pedals, said pedal mounting means being mechanically coupled to said inverted V-shaped supporting member.

f. a handlebar support pole which is adjustably coupled to the set of handlebars;

g. second pivotal mounting means for pivotally coupling sais handlebar support pole to said inverted V-shaped supporting member; and h. second locking means for adjustably locking said handlebar support pole in place to said first and second inverted U-shaped members.

6. An exercising apparatus for simulating the riding of a exercycle according to claim 5 wherein said seat mounting means comprises:

a. a seat support pole which is adjustably coupled to the seat;

b. first pivotal mounting means for pivotally coupling said seat support pole at multiple angles to said inverted V-shaped supporting member; and c. first locking means for adjustably locking said seat support pole in place to said first and second inverted U-shaped members.

* * * * *